US011628446B2

(12) United States Patent
Gingras et al.

(10) Patent No.: US 11,628,446 B2
(45) Date of Patent: Apr. 18, 2023

(54) FLINGER APPARATUS FOR A COUNTER-ROTATING REFINER

(71) Applicant: Andritz Inc., Alpharetta, GA (US)

(72) Inventors: Luc Gingras, Harrogate (GB); Marc Berger, Lachine (CA)

(73) Assignee: ANDRITZ INC., Alpharetta, GA (US)

( * ) Notice: Subject to any disclaimer, the term of this patent is extended or adjusted under 35 U.S.C. 154(b) by 206 days.

(21) Appl. No.: 17/027,247

(22) Filed: Sep. 21, 2020

(65) Prior Publication Data

US 2021/0086189 A1 Mar. 25, 2021

Related U.S. Application Data

(60) Provisional application No. 62/904,236, filed on Sep. 23, 2019.

(51) Int. Cl.

| | |
|---|---|
| ***B02C 7/12*** | (2006.01) |
| ***D21D 1/30*** | (2006.01) |
| ***B02C 7/02*** | (2006.01) |

(52) U.S. Cl.

CPC ..... *B02C 7/12* (2013.01); *B02C 7/02* (2013.01); *D21D 1/30* (2013.01); *D21D 1/303* (2013.01); *D21D 1/306* (2013.01)

(58) Field of Classification Search

CPC ..... D21D 1/30; D21D 1/303; D21D 1/306; D21D 1/34; D21D 1/36; B02C 7/12; B02C 7/02

See application file for complete search history.

(56) References Cited

U.S. PATENT DOCUMENTS

| | | | | |
|---|---|---|---|---|
| 3,170,649 A * | 2/1965 | Fisher | D21D 1/30 241/298 |
| 3,371,873 A * | 3/1968 | Thomas | D21D 1/30 241/290 |
| 4,619,414 A | 10/1986 | Kirchner et al. | |
| 5,167,373 A | 12/1992 | Bohn et al. | |
| 5,449,122 A | 9/1995 | Berger et al. | |

(Continued)

FOREIGN PATENT DOCUMENTS

| | | |
|---|---|---|
| EP | 3023540 | 5/2016 |
| RU | 2372433 | 11/2009 |

(Continued)

OTHER PUBLICATIONS

International Application No. PCT/US2020/051979, International Preliminary Report on Patentability dated Apr. 7, 2022, 7 pages.

(Continued)

*Primary Examiner* — Faye Francis

(74) *Attorney, Agent, or Firm* — Kilpatrick Townsend & Stockton LLP

(57) ABSTRACT

This disclosure relates to an apparatus for a counter-rotating mechanical refiner configured to mitigate the problems of feeding variations, load variations, high energy consumption due to poor feeding efficiency, low pulp quality, and reduced throughput capacity by positioning a flinger proximate to a rotor gap side of a first rotor, wherein the first rotor further comprises an inlet extending through the first rotor, such that a portion of the operational flinger deflects feed material from the inlet into the refiner gap while rotating in the direction of the first rotor.

20 Claims, 2 Drawing Sheets

(56) References Cited

U.S. PATENT DOCUMENTS

| | | | | |
|---|---|---|---|---|
| 5,836,530 | A | 11/1998 | Pilao | |
| 5,875,982 | A * | 3/1999 | Underberg | D21D 1/306 241/261.3 |
| 5,934,585 | A | 8/1999 | Chaney et al. | |
| 7,347,392 | B2 * | 3/2008 | Johansson | D21D 1/306 241/261.3 |
| 8,262,861 | B2 * | 9/2012 | Johansson | B02C 7/12 162/261 |
| 8,734,611 | B2 | 5/2014 | Sabourin et al. | |
| 2002/0070303 | A1 * | 6/2002 | Johansson | B02C 7/12 241/261.3 |
| 2003/0065453 | A1 * | 4/2003 | Johansson | D21D 1/30 422/112 |
| 2005/0211809 | A1 * | 9/2005 | Lutz | D21D 1/30 241/261.2 |
| 2006/0108465 | A1 * | 5/2006 | Barscevicius | B02C 25/00 241/261.2 |
| 2006/0175447 | A1 * | 8/2006 | Duggan | B02C 7/12 241/261.2 |
| 2006/0192040 | A1 * | 8/2006 | Johansson | B02C 7/12 241/261.3 |
| 2016/0138220 | A1 * | 5/2016 | Gingras | D21D 1/306 241/298 |
| 2019/0264389 | A1 * | 8/2019 | Gingras | D21D 1/303 |

FOREIGN PATENT DOCUMENTS

| | | | |
|---|---|---|---|
| WO | 8504431 | A1 | 10/1985 |
| WO | 9525199 | | 9/1995 |
| WO | 0027531 | | 5/2000 |

OTHER PUBLICATIONS

International Application No. PCT/US2020/051979, International Search Report and Written Opinion dated Oct. 29, 2020, 9 pages.
Australian Application No. 2020352514, First Examination Report dated Oct. 5, 2022, 3 pages.
Canadian Application No. 3,148,842, Office Action dated Feb. 14, 2023, 4 pages.
Swedish Application No. 2250448-4, Office Action dated Jan. 12, 2023, 5 pages.

* cited by examiner

FLINGER APPARATUS FOR A COUNTER-ROTATING REFINER

CROSS-RELATED APPLICATION

This application claims the benefit under 35 U.S.C. § 119(e) of the earlier filing date of U.S. Provisional Patent Application No. 62/904,236 filed on Sep. 23, 2019 the entire contents of which is incorporated herein by reference.

BACKGROUND OF THE INVENTION

1. Technical Field

The present disclosure relates generally to mechanical refiners configured to develop and expose fibers in fibrous materials and more particularly to a flinger for counter-rotating mechanical refiners.

2. Related Art

Mechanical pulping refiners typically separate, develop, and cut lignocellulosic material into fibers to endow the fibers with certain mechanical and physical properties suitable for use in pulp, paper, boards, building materials, packing materials, liquid-absorbent filler materials, and other products.

A mechanical refiner typically comprises two or more opposing refiner assemblies. Each assembly has a pattern of raised refining bars on a refining side. Grooves separate adjacent refining bars. Typically, these refining assemblies are either circular discs, annular discs, or nested conical frustums configured to rotate around a common axis. Each refiner assembly may comprise several annular sector-shaped segments bolted to a backing structure to form the refiner circular disc, refiner annular disc, or refiner conical frustum. The refining sides of the opposing refining assemblies face each other to define a narrow refining gap separating the opposing refiner assemblies. At least one of the refining assemblies is a rotor configured to rotate around the axis.

As the rotor refining assembly spins at high speeds, operators feed lignocellulosic material or other feed material through the refining gap. The refining bars and grooves on opposing refiner assemblies successively overlap as the rotor spins. A typical rotor refiner assembly spins in a range of 800 to 2,300 rotations per minute ("rpm"). The successively overlapping opposing bars and grooves alternatively compress and permit the expansion of lignocellulosic material in the refining gap. This rapid alternating compression and expansion creates a fiber pad, which is the primary location where mechanical refining occurs. In other words, forceful movement of feed material against adjacent feed material in the fiber pad contributes primarily to the fiber's development, separation, and cutting. This is known as "refining."

The movement of feed material into the refining gap can be thought of generally as a "centrifugal feeding effect." "Centrifugal force" is a fictitious force that appears to push feed material outward from the rotor discs' center of rotation in a rotating reference frame and this "force" is actually a result of the feed material's inertia. Nonetheless, "centrifugal force" is a useful way to visualize the feed material's radially outward movement once the feed material enters the space between the opposing refining assemblies. Likewise, "centrifugal feeding effect" is a useful way to describe the feed material flowing radially outward into the refining gap between refining assemblies. The "centrifugal feeding effect" therefore generally describes the movement of feed material into the refining gap.

"Counter-rotating disc refiners" are types of mechanical refiners that have two discs configured to rotate in opposite directions. Feed material enters the refining gap via openings on what is call the "feed rotor assembly." Usually, a large amount of water and/or steam is used to push the material across and ensure good and stable feed. The feed material tends to rotate at or near the rotating speed of the feeding disc, since the feed material must pass the openings across the feeding disc. In this manner, the feed material will hit and be rotated by the sides of the inlet openings that extend through the feed disc. The feed material then hits the opposite disc, called the "control rotor assembly", which rotates in the opposite direction of the feed rotor assembly. When this occurs, the feed material experiences a significant loss of rotational velocity. The feed material may even reverse rotational direction and begin flowing in the opposite direction of the feed rotor assembly (i.e. in the rotational direction of the control rotor assembly). This effectively partially stalls the incoming feed material because the feed material loses rotational speed and therefore centrifugal feeding effect.

As a result, counter-rotating refiners have a limited feeding effect towards the inlet of the refining zone (i.e. the place where refining occurs). This results in feeding variations, load variations, a potentially higher energy consumption due to poor feed efficiency, and lower pulp quality. Usually, due to the described conditions, these counter-rotating refiners are run with a lower operating pulp consistency, compared to single-disc or conical-disc refiners, which also results in less fiber development.

The state of the art consists of letting the feed material enter the space between the two opposing rotor assemblies and allowing the feed material to hit the control rotor assembly's center plate first. This center plate may or may not have feed bars on its surface.

The presence of feed bars increases the change in rotational direction but may not always provide a good centrifugal feeding effect because the feed material rotates in opposite direction to the material that continuously enters this area. This causes rotational interference between the incoming material rotating in one direction, and the redirected material rotating in the opposite direction. The ultimate result is a significant reduction in centrifugal feeding effect. Additionally, feeder bars on the control disc are usually seriously affected by water erosion and cavitation, since dilution water is hitting these feeding bars at high flow rates and high velocity. This also causes maintenance costs and increased service downtimes.

It is possible and common to use a smooth surface on the control inlet area, so the feed material will not be turned to the opposite direction of rotation, nor will significant cavitation occur. However, the smooth surface will still slow down the rotational effect on the feed material, which will continue to rotate in the direction of the feed rotor assembly, but at a somewhat reduced rotational velocity. Furthermore, there are no longer any elements in the feed area that will mechanically transfer rotational forces to the feed material until the feed material enters the refining gap. The feeding effect is therefore generated by the weak centrifugal effect, and to some less degree, gravitational forces that will force the feed material downwards and eventually into the refining gap.

There is a need for a design concept that allows a more efficient hand-off from the feed rotor assembly into the refining gap of a counter-rotating refiner, in order to improve refiner efficiency, improve pulp quality, and increase the refiner's throughput capacity.

SUMMARY OF THE INVENTION

The problems of feeding variations, load variations, high energy consumption due to poor feeding efficiency, low pulp quality, and reduced throughput capacity in a counter-rotating mechanical refiner is solved by a feed rotor assembly for a counter-rotating refiner comprising: a first rotor configured to rotate in a first direction, the first rotor having: an upstream side, a rotor gap side distally disposed from the upstream side, an inlet extending through the first rotor, wherein the inlet has an inlet gap end, and wherein the inlet fluidly communicates with the rotor gap side at the inlet gap end, and a flinger disposed at the rotor gap side, wherein the flinger rotates in the first direction with the first rotor, and wherein the flinger has a portion obstructing the inlet gap end.

Instead of allowing the feed to hit the control disc when entering through the openings on the feed disc (and therefore lose a significant amount of rotational speed and therefore centrifugal feeding effect), an exemplary flinger (also known as a rotor cap) is mounted on the rotor gap end of the first rotor, which comprises the feed rotor assembly. It is contemplated that exemplary embodiments described more fully herein create a captive area for the feed material, which then forces the feed material to continue rotating at the full rotational speed of the first rotor until released at, or in proximity to the start of the refining zone, without the possibility of interacting with the control rotor assembly. It is contemplated that this thereby prevents a loss of feeding effect.

It is contemplated that the exemplary embodiments described herein may provide a clear path for the feed material, such that the feed material will rotate in the direction of the feed rotor assembly until the feed material enters the refining gap.

It is contemplated that the exemplary feed rotor assembly and flinger as described herein will permit more controlled and efficient feeding effect over the prior art. The improved centrifugal feeding effect could permit increased throughput, a reduction in the need for dilution water and/or steam, and improved stability of the counter-rotating mechanical refiner.

Without being bound by theory, it is contemplated that the flinger associated with the feed rotor assembly can create fixed pockets together with the inlet openings in the first rotor, or the flinger can act as a target plate that prevents feed material from reaching the control refining assembly. The exemplary flinger may have bars to convey a stronger feed into the refining gap. In other exemplary embodiments, the flinger may have a smooth surface to allow distribution and continued feed without the slowing effect of hitting the control disc.

It is understood that many variations of this concept can be created, so long as a design feature (which may also be part of the feed rotor itself, or a plate holder that would be attached to the feed rotor) is preventing the feed material of a counter-rotating refiner to hit the opposite disc before being fed into the refining gap.

BRIEF DESCRIPTION OF THE DRAWINGS

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

DETAILED DESCRIPTION OF THE INVENTION

Figure 1B:
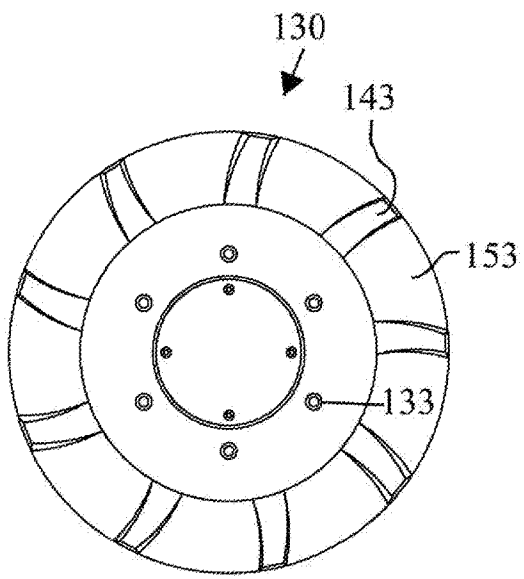
FIG. 1B is a facing view of an exemplary flinger configured to rotate in the direction of the first rotor and to obstruct the inlet gap end of an inlet extending through the first rotor.

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Similar reference characters indicate corresponding parts throughout the several views unless otherwise stated. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

It should be noted that some of the terms used herein are relative terms. For example, the terms "upper" and "lower" are relative to each other in location, i.e. an upper component is located at a higher elevation than a lower component in a given orientation, but these terms can change if the device is flipped. The terms "uphill" and "downhill" are relative to the angled drum of a rotary drum assembly. For example, an "uphill" side of an exemplary rotary support assembly is disposed closer to the upper end of a rotary drum assembly than it is to the lower, downhill end of the rotary drum assembly. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow of fluids through an upstream component prior to flowing through the downstream component.

The terms "horizontal" and "vertical" are used to indicate direction relative to an absolute reference, i.e. ground level. However, these terms should not be construed to require structure to be absolutely parallel or absolutely perpendicular to each other. For example, a first vertical structure and a second vertical structure are not necessarily parallel to each other. The terms "top" and "bottom" or "base" are used to refer to locations/surfaces where the top is always higher than the bottom/base relative to an absolute reference, i.e. the surface of the Earth. The terms "upwards" and "downwards" are also relative to an absolute reference; an upwards flow is always against the gravity of the Earth.

Figure 1A:
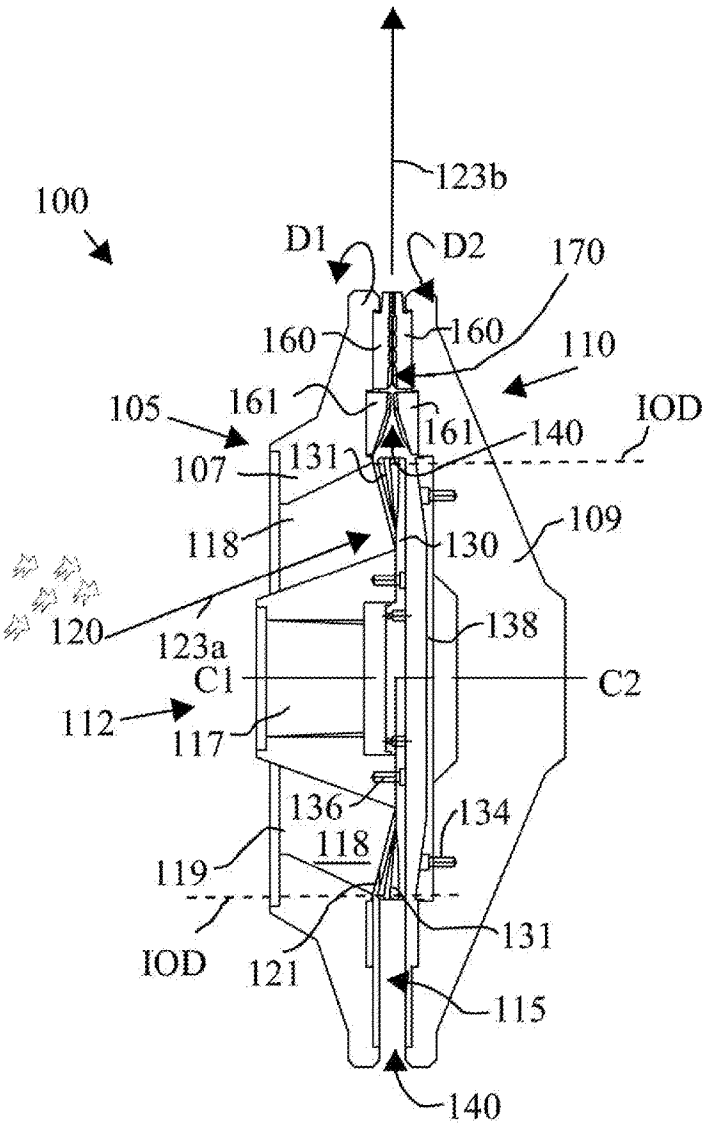
FIG. 1A is a schematic cross-sectional side view of an exemplary counter-rotating refiner assembly having a flinger disposed at the rotor gap side of the feed rotor assembly.

FIG. 1A depicts a cross-sectional side view of an exemplary counter-rotating refiner assembly 100 comprising a feed rotor assembly 105 oppositely disposed from a control rotor assembly 110. The feed rotor assembly 105 comprises a first rotor 107. The control rotor assembly 110 comprises a second rotor 109. The first rotor 107 has an upstream side 112 and a rotor gap side 115 distally disposed from the upstream side 112. Typically, a drive shaft 117 engages the first rotor 107 around the first rotor's center of rotation C1. A motor (not depicted) engages the drive shaft 117. In this way, the first rotor 107 is configured to rotate in a first direction D1. It will be understood that the first direction may be either clockwise or counterclockwise relative to the second direction D2 of the control rotor assembly 110 provided that the second direction D2 is opposite from the first direction D1. For example, the first direction D1 is clockwise, the second direction D2 is counterclockwise and vice versa. The control rotor 110 likewise engages a drive shaft (not depicted) and a motor (not depicted) and is configured to rotate in the second direction D2 in this manner.

The first rotor 107 further comprises an inlet 118. In the depicted embodiment, the inlet 118 has an upstream inlet end 119 and an inlet gap end 121 distally disposed from the upstream inlet end 119. The inlet 118 fluidly communicates with the rotor gap side 115 at the inlet gap end 121. That is, feed material 120 entering the inlet 118 from the upstream side 112 can pass through the inlet 118 and exit the inlet 118 on the rotor gap side 115. In certain exemplary embodiments, the first rotor 107 comprises more than one inlet 118. In other exemplary embodiments, the inlet 118 may be a single inlet 118. In certain embodiments having a single inlet 118, the inlet 118 can be disposed coaxial with the center of rotation C1.

The first rotor 107 further comprises a flinger 130 disposed at the rotor gap side 115. The flinger 130 as a portion 131 disposed adjacent to the inlet gap end 121 and, in this manner, the portion 131 obstructs the inlet gap end 121. Preferably, this portion 131 extends radially to, near, or beyond the outer diameter IOD of the inlet 118 to deflect the maximum amount of feed material 120 into the refining gap 140. The flinger 130 can extend no further than the inner diameter of the refining segments (see 161 and 160) that comprise the refining gap 140. In practice, the "refining gap" is the space defined by opposing refining segments (see 161 and 160) in a refiner assembly (see 100). It will be understood that in embodiments that lack separate breaker bar segments 161, the refining gap generally begins (relative to the path of feed material movement) at the inner diameter of the opposing refiner plate segments 160. The portion 131 of the flinger 130 redirects the path 123*a* of feed material 120 into the refining gap 140 while the portion 131 is rotating in the same direction of rotation D1 as the first rotor 107. In the depicted embodiment, the flinger 130 comprises flinger fastener holes 133 (FIG. 1B) that align with first rotor fastener holes 134 at the rotor gap side 115. Fasteners 136 extend through both the flinger fastener holes 133 and the first rotor fastener holes 134 to secure the flinger 130 to the rotor gap side 115. In this manner, the flinger 130 fixedly engages the first rotor 107 at the rotor gap side 115. This fixing configuration permits the flinger 130 to rotate in the first direction D1 with the first rotor 107, while allowing the portion 131 of the flinger 130 that obstructs the inlet gap end 121 to deflect feed material 120 into the refining gap 140.

It will be understood that in other exemplary embodiments that the finger 130 can be fused to the rotor gap side 115. For example, the first rotor 107 and flinger 130 can be manufactured as a single piece or manufacturers or installers can weld or otherwise fuse the flinger 130 to the rotor gap side 115 of the first rotor 107. In other exemplary embodiments, a plate holder (see 135, FIG. 2A) can be disposed between the flinger 130 and first rotor 107. In other exemplary embodiments, the flinger 130 can be a plate configured to receive removable bars. These removable bars can be fastened to the flinger plate and thereby removably yet fixedly engage the flinger plate for example.

Figure 2B:
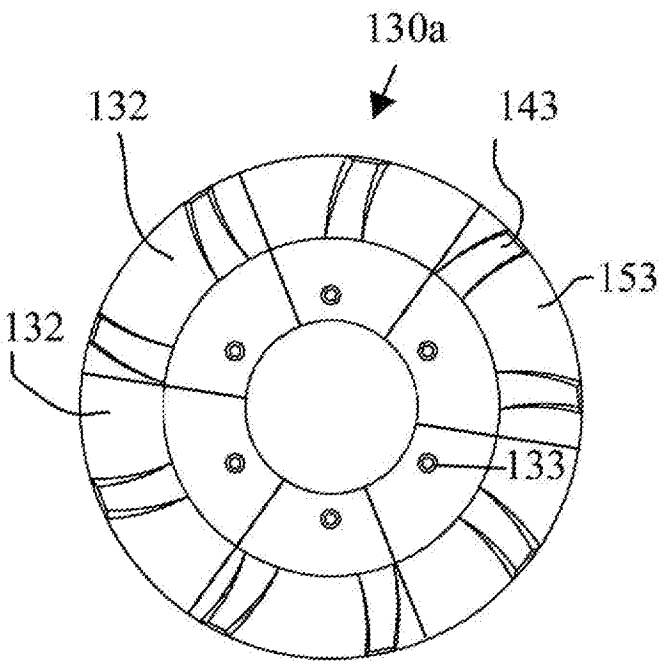
FIG. 2B is a facing view of an exemplary segmented flinger configured to rotate in the direction of the first rotor and to obstruct the inlet gap end of an inlet extending through the first rotor.
Figure 2A:
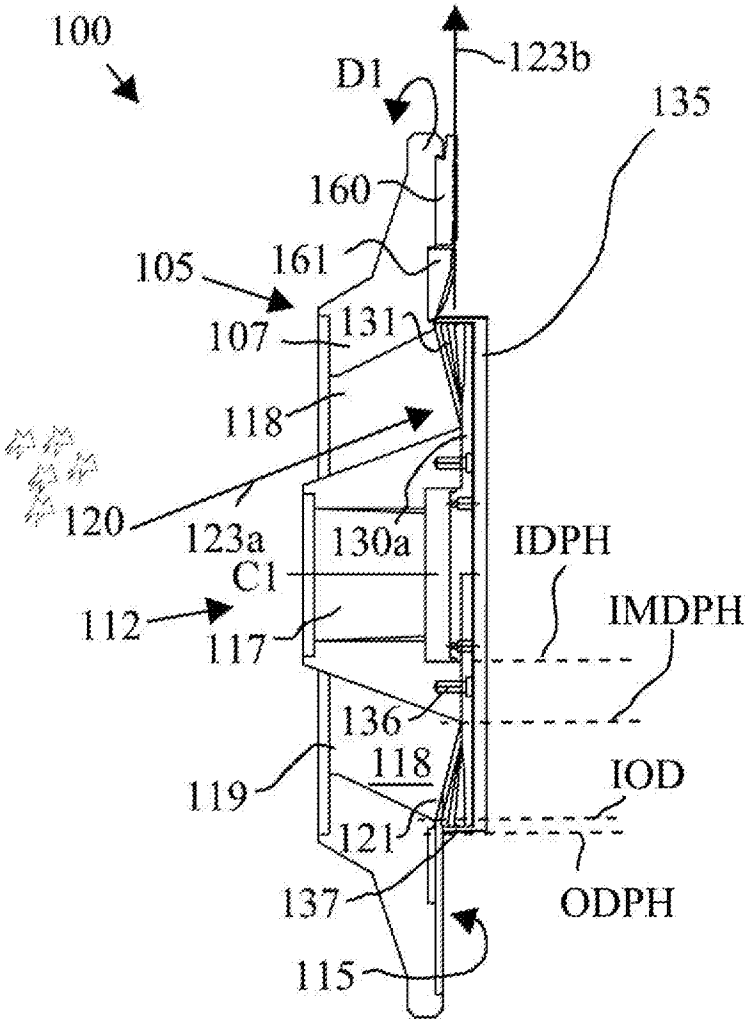
FIG. 2A is a schematic cross-sectional side view of an exemplary counter-rotating refiner assembly depicting the feed rotor assembly having a segmented flinger disc and a plate holder disposed over the segmented flinger disc.

In still other exemplary embodiments, the flinger 130*a* can be segmented. With reference to FIGS. 2A and 2B, a segmented flinger 130*a* can comprise a number or annular or sector-shaped flinger plate segments 132. When the flinger

130*a* is segmented, a plate holder 135 can be disposed around the segmented flinger 130*a* and engage the first rotor 107 with fasteners to balance the centrifugal forces applied to the segmented flinger 130*a*. Stated differently, the segmented flinger 130*a* can be disposed between the rotor gap side 115 and a plate holder 135. The plate holder 135 can have lips 137 at the outer diameter ODPH of the plate holder 135 that engage the portion 131 of the segmented flinger 130*a* that redirects the feed material 120 into the refining gap 140. In this manner, the plate holder 135 is configured to balance the centrifugal forces applied to the segmented flinger 130*a* (i.e. "pilot" the segmented flinger 130*a*) as the first rotor 107 spins. In other exemplary embodiments, the lips 137 can be disposed at an inner diameter of the plate holder IDPH to pilot the segmented flinger 130*a*. In still other exemplary embodiments, the lips can be disposed at an intermediate diameter of the plate holder IMDPH between the other diameter and the inner diameter to pilot the segmented flinger 130*a*.

FIG. 2B further illustrates the segmented flinger 130*a* in a facing view. The segmented flinger 130*a* comprises multiple flinger plate segments 132. Each flinger plate segment 132 can have at least one flinger bar 142 disposed between wide flinger grooves 153. Flinger fastener holes 133 permit a fastener to engage the segmented flinger 130 to the first rotor 107. The plate holder 135 can have fastener holes aligning with the flinger fastener holes 133 to engage the segmented flinger 130*a* and the first rotor 107. In other exemplary embodiments, the plate holder fastener holes do not align with both the flinger fastener holes 133 and the first rotor fastener holes 134.

In still other exemplary embodiments, the flinger 130 can be affixed directly to the drive shaft 117 in lieu of being affixed to the first rotor 107. In still other exemplary embodiments, a separate rotational device (e.g. a separate drive shaft, separate motor, etc.) can rotate the flinger 130 in the first rotational direction D1 independent of the rotational device used to rotate the first rotor 107 in the first rotational direction D1. It will be appreciated that any manner of positioning the flinger 130 proximate to the inlet gap end 121 such that a portion 131 of the operational flinger 130 deflects feed material 120 into the refiner gap 140 and such that the flinger 130 rotates in the first direction D1 is considered to be within the scope of this disclosure.

Bars of any height and size are within the scope of this disclosure. Bars in contact with the feed disc are also considered to be within the scope of this disclosure.

In an exemplary embodiment, the counter-rotating refiner assembly 100 comprises a feed rotor assembly 105 further comprising a plate holder on which refiner plate segments 160 are assembled. This plate holder is bolted to the refiner disc, with a feed plate holder having feeding holes and a control plate holder which has no holes but has a center piece. In this exemplary embodiment, the feed plate holder is manufactured in a way that provides the flinger as integral part. In other exemplary embodiments, the feed plate holder having feeding holes has a separate and discrete flinger attached to the feed plate holder. In yet other exemplary embodiments, the flinger 130 is attached to the feed rotor disc through a central opening of the plate holder.

In certain exemplary embodiments, it can be desirable for the flinger 130 to rotate in the first direction D1 at or near the rate of rotation of the first rotor 107. By way of example, the first rotor 107 can rotate in a range of 800 rpm to 2,300 rpm.

As FIG. 1A further illustrates, the feed rotor assembly 105 and the control rotor assembly 110 can further comprise refiner plate segments 160 and breaker bar segments 161. The refining plate segments 160 have a refining side comprising a pattern of alternating bars and grooves. Similarly, the breaker bar segments 161 have a breaker side comprising a pattern of alternating wide bars and wide grooves (that is, wide compared to the bars and grooves on the radially distal refining plate segments). In smaller diameter counter-rotating refiners, the breaker segments 161 are omitted. The refiner plate segments 160 may also have a breaker bar section disposed radially inward of the refiner bars and grooves that comprise the refining zone 170. The facing, opposing refining sides and breaker bars sides define a narrow refining gap 140 between the feed rotor assembly 105 and the control rotor assembly 110. The portion of the refining gap 140 disposed between the opposing refiner plate segments 160 is known as the "refining zone" 170.

In operation, the feed rotor assembly 105 rotates in the first direction D1 and the oppositely disposed control rotor assembly 110 rotates in the second direction D2, wherein the second direction is opposite from the first direction D1. Operators introduce feed material 120 through the inlet 118 extending through the first rotor 107. Usually, operators use a large amount of water and/or steam to push the feed material 120 through the inlet 118 to insure a stable feed rate. This is particularly the case when the feed material 120 is lignocellulosic feed material such as wood chips, or other particularly viscous fibrous material. The feed material 120 generally follows path 123*a* toward the inlet gap end 121.

Without being bound by theory, it is believed that the flinger 130 creates a captive area for the feed material 120 near the inlet gap end 121, which forces the feed material 120 to keep rotating at or near the full rotational speed of the first rotor 107 until the feed material 120 is released at or near the start of the refining zone 170 without the possibility of interacting with the control disc, which would lead to a loss of the feeding effect.

The control rotor assembly 110 may further comprise a rotor cap 138. This control rotor cap 138 may contain wide rotor cap feeder bars and grooves. In other embodiments, the control rotor cap 138 lacks feeder bars. In still other exemplary embodiments, the rotor cap 138 is omitted.

FIG. 1B is a facing view of an exemplary flinger 130 configured to rotate in the direction of the first rotor 107 and to obstruct the inlet gap end 121 of an inlets 118 extending through the first rotor 107. The embodiment of FIG. 1B has flinger bars 143 widely spaced around the flinger 130. These flinger bars 143 may be desirably disposed at a feeding angle to facilitate the movement of feed material 120 from the first rotor 107 into the refining gap 140 at or near the same rotational velocity as the spinning first rotor 107. The flinger 130 also has wide flinger grooves 153 disposed between the flinger bars 143. In other exemplary embodiments, the flinger bars 143 may be absent.

An exemplary feed rotor assembly comprises: a first rotor configured to rotate in a first direction, the first rotor having: an upstream side, a rotor gap side distally disposed from the upstream side, an inlet extending through the first rotor, wherein the inlet has an inlet gap end, and wherein the inlet fluidly communicates with the rotor gap side at the inlet gap end, and a flinger disposed at the rotor gap side, wherein the flinger rotates in the first direction with the first rotor, and wherein the flinger has a portion disposed adjacent to the inlet gap end such that the portion is configured to obstruct the inlet gap end.

In certain exemplary embodiments, the flinger is a segmented flinger, and the first rotor assembly further comprises a plate holder configured to pilot the segmented flinger at a diameter, wherein the diameter is one of an inner diameter, an intermediate diameter, or an outer diameter.

In certain exemplary embodiments, the feed rotor assembly further comprises a plate holder, wherein the plate holder is disposed between the flinger and the first rotor.

In certain exemplary embodiments, the feed rotor assembly further comprises a plate holder, wherein the flinger is disposed between the plate holder and the first rotor.

In certain exemplary embodiments, the flinger further comprises flinger bars.

In certain exemplary embodiments, the flinger lacks flinger bars.

In certain exemplary embodiments, the flinger is fused to the rotor gap side of the first rotor.

In certain exemplary embodiments, the portion of the flinger extends radially to the outer diameter of the inlet.

In certain exemplary embodiments, the portion of the flinger extends radially beyond the outer diameter of the inlet.

In certain exemplary embodiments, a separate rotational device rotates the flinger in the first rotational direction independent of the rotational device used to rotate the first rotor.

An exemplary counter-rotating refiner assembly comprises: a feed rotor assembly having: a first rotor configured to rotate in a first direction, the first rotor having: an upstream side, a rotor gap side distally disposed from the upstream side, an inlet extending through the first rotor, wherein the inlet has an inlet gap end, and wherein the inlet fluidly communicates with the rotor gap side, and a flinger disposed at the rotor gap side, wherein the flinger rotates in the first direction with the first rotor, and wherein the flinger has a portion obstructing the inlet gap end, and a control rotor assembly having: a second rotor oppositely disposed from the feed rotor assembly, wherein the second rotor is configured to rotate in a second direction, wherein the second direction is an opposite direction to the first direction of the first rotor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the invention.

What is claimed is:

1. A feed rotor assembly comprising:

a rotor configured to rotate in a first rotational direction, the rotor having:

an upstream side comprising a feedstock inlet;

a rotor gap side distally disposed from the upstream side, wherein the rotor gap side faces a refining gap, wherein the feedstock inlet extends through the rotor, wherein the feedstock inlet has an inlet gap end, and wherein the feedstock inlet fluidly communicates with the rotor gap side at the inlet gap end; and a flinger disposed at the rotor gap side, wherein the flinger rotates in the first rotational direction with the rotor, and wherein the flinger has a portion disposed adjacent to the inlet gap end such that the portion is configured to obstruct the inlet gap end.

2. The feed rotor assembly of claim 1, wherein the flinger is a segmented flinger, and wherein the feed rotor assembly further comprises a plate holder configured to pilot the segmented flinger at a diameter, and wherein the diameter is one of an inner diameter, an intermediate diameter, or an outer diameter.

3. The feed rotor assembly of claim 1 further comprising a plate holder, wherein the plate holder is disposed between the flinger and the rotor.

4. The feed rotor assembly of claim 1 further comprising a plate holder, wherein the flinger is disposed between the plate holder and the rotor.

5. The feed rotor assembly of claim 1, wherein the flinger further comprises flinger bars.

6. The feed rotor assembly of claim 1, wherein the flinger lacks flinger bars.

7. The feed rotor assembly of claim 1, wherein the flinger is fused to the rotor gap side of the rotor.

8. The feed rotor assembly of claim 1, wherein the portion of the flinger extends radially to an outer diameter of the feedstock inlet.

9. The feed rotor assembly of claim 1, wherein the portion of the flinger extends radially beyond an outer diameter of the feedstock inlet.

10. The feed rotor assembly of claim 1, wherein a separate rotational device rotates the flinger in the first rotational direction independent of a rotational device used to rotate the rotor.

11. A counter-rotating refiner assembly comprising:

a feed rotor assembly having:

a first rotor configured to rotate in a first rotational direction, the first rotor having:

an upstream side comprising a feedstock inlet;

a rotor gap side distally disposed from the upstream side, wherein the rotor gap side faces a refining gap, wherein the feedstock inlet extends through the first rotor, wherein the feedstock inlet has an inlet gap end, and wherein the feedstock inlet fluidly communicates with the rotor gap side, and a flinger disposed at the rotor gap side, wherein the flinger rotates in the first rotational direction with the first rotor, and wherein the flinger has a portion obstructing the inlet gap end; and a control rotor assembly having:

a second rotor oppositely disposed from the feed rotor assembly, wherein the second rotor is configured to rotate in a second rotational direction, wherein the second rotational direction is an opposite direction to the first rotational direction of the first rotor.

12. The feed rotor assembly of claim 11, wherein the flinger is a segmented flinger, and wherein the first rotor further comprises a plate holder configured to pilot the segmented flinger at a diameter, and wherein the diameter is one of an inner diameter, an intermediate diameter, and/or outer diameter.

13. The feed rotor assembly of claim 11 further comprising a plate holder, wherein the plate holder is disposed between the flinger and the first rotor.

14. The feed rotor assembly of claim 11 further comprising a plate holder, wherein the flinger is disposed between the plate holder and the first rotor.

15. The feed rotor assembly of claim 11, wherein the flinger further comprises flinger bars.

16. The feed rotor assembly of claim 11, wherein the flinger lacks flinger bars.

17. The feed rotor assembly of claim 11, wherein the flinger is fused to the rotor gap side of the first rotor.

18. The feed rotor assembly of claim 11, wherein the portion of the flinger extends radially to an outer diameter of the feedstock inlet.

19. The feed rotor assembly of claim 11, wherein the portion of the flinger extends radially beyond an outer diameter of the feedstock inlet.

20. The feed rotor assembly of claim 11, wherein a separate rotational device rotates the flinger in the first rotational direction independent of a rotational device used to rotate the first rotor.

* * * * *